US009108304B2

(12) United States Patent
Lai

(10) Patent No.: US 9,108,304 B2
(45) Date of Patent: Aug. 18, 2015

(54) RATCHET SCREWDRIVER ABLE TO CHANGE OPERATING DIRECTION

(71) Applicant: Jin Tsai Lai, Taichung (TW)

(72) Inventor: Jin Tsai Lai, Taichung (TW)

( * ) Notice: Subject to any disclaimer, the term of this patent is extended or adjusted under 35 U.S.C. 154(b) by 292 days.

(21) Appl. No.: 13/892,318

(22) Filed: May 13, 2013

(65) Prior Publication Data

US 2013/0319185 A1 Dec. 5, 2013

(30) Foreign Application Priority Data

May 29, 2012 (DE) ..... 10 2012 010 528

(51) Int. Cl.
*B25B 15/04* (2006.01)
*B25B 13/46* (2006.01)

(52) U.S. Cl.
CPC ..... *B25B 15/04* (2013.01); *B25B 13/463* (2013.01); *B25B 13/468* (2013.01)

(58) Field of Classification Search
CPC .... B25B 13/46; B25B 13/462; B25B 13/463; B25B 13/468; B25B 15/001; B25B 15/04
USPC ..... 81/60, 62, 63.1
See application file for complete search history.

(56) References Cited

U.S. PATENT DOCUMENTS 7,353,734 B1 * 4/2008 Hu ..... 81/62
7,520,198 B1 * 4/2009 Lin ..... 81/63
7,762,161 B2 * 7/2010 Lai ..... 81/63.1

* cited by examiner

*Primary Examiner* — Hadi Shakeri
(74) *Attorney, Agent, or Firm* — Che-Yang Chen; Law Office of Michael Chen

(57) ABSTRACT

A ratchet screwdriver includes a handle, a shaft and a ratchet switch device. The shaft is connected to the front end of the handle and a mounting member is connected to the handle so as to be connected with the shaft. The ratchet switch device is located in the chamber in the rear end of the handle and includes a base, a frame, two engaging members, a positioning member, a resilient plate, two positioning pieces, and a ratchet member a switch. The shaft can be replaced by operating the mounting member on the handle. The switch on the rear end of the handle can change the direction of the ratchet member to output torque via the shaft.

7 Claims, 11 Drawing Sheets

RATCHET SCREWDRIVER ABLE TO CHANGE OPERATING DIRECTION

FIELD OF THE INVENTION

The present invention relates to a ratchet screwdriver, and more particularly, to a switch device located at the rear end of the handle of a ratchet screwdriver so as to change the operating direction of the ratchet screwdriver.

BACKGROUND OF THE INVENTION

The conventional screwdriver generally comprises a handle and a shaft which is integrally connected with the handle, and bits are connected to the shaft to tighten or loosen objects such as bolts and screws. There are different tips for the bits, such as the cabinet tip, the keystone tip, hexagonal tip, and the Phillips head tip, to be cooperated with different objects. In other words, users have to carry as many bits as possible to meet the practical needs. Besides, when tightening or loosening the objects, the users hold the handle to rotate the screwdriver, and then the holding hand is released to adjust the position. After adjusting, the users hold the handle again to rotate the screwdriver. The steps must be taken repeatedly to tighten or loosen the objects. This is a time-consuming task and has low efficiency. When releasing the hand from the handle, the users have to keep the screwdriver at the proper position, or the bit will be disengaged from the object. The ratchet screwdrivers improve the shortcomings and the users simply rotate the ratchet screwdrivers back and forth to tighten or loosen the objects. However, changing operating direction of the ratchet screwdriver may not be reliable because the ratchet device may be stocked or disengaged from the ratchet wheel.

The present invention intends to provide a ratchet screwdriver able to change turning direction by a switch at the rear end of the handle and improves the shortcomings of the conventional ratchet screwdrivers.

SUMMARY OF THE INVENTION

The present invention relates to a ratchet screwdriver which comprises a handle, a shaft and a ratchet switch device.

The handle having a mounting member connected to the front end thereof and a chamber is defined in the rear end of the handle. A passage is defined in the handle.

The shaft is inserted to the front end of the handle and made by metal. The shaft has a function end on the front end thereof and an insertion end is formed on the rear end of the shaft. A positioning recess is defined in the shaft and connected with the mounting member.

The ratchet switch device is located in the chamber of the handle and has a base which has a room defined therein. Two first slots are defined in two opposite sidewalls of the base. A recessed area is defined in the rear end of the base and has multiple notches defined in one side thereof. A through hole is defined through the inside of the recessed area and communicates with the room. A frame is located in the room of the base and has a recess defined therein. A central hole is defined through the frame and a fastening member extends through the central hole. Each of two ends of the frame has a reception hole and a stop. Two engaging members are connected to the two ends of the frame and each has ratchet teeth. Each of the two engaging members has an insertion which is inserted into the reception hole corresponding thereto. The two engaging members contact the stops of the frame. A positioning member is located in the recess of the frame and the room of the base. The positioning member has a space defined therein and two second slots are defined in two opposite walls thereof. A through hole is defined through the positioning member. A resilient plate is located in the space of the positioning member and each of two ends of the resilient plate has a contact end. The two engaging members contact the contact ends respectively. Two positioning pieces are located in the room of the base and a ratchet member is located in the room of the base. The ratchet member has ratchet teeth defined in outside thereof so as to be engaged with the ratchet teeth of the two engaging members. The first end of the ratchet member has a reception recess into which the insertion end of the shaft is inserted. A tubular part extends from the second end of the ratchet member and extends through the through hole of the positioning member. The tubular part has an annular groove with which a clip is engaged so as to connect the ratchet member with the positioning member. A switch is located in the recessed area of the base and connected with the frame. The switch has a boss extending therefrom which is engaged with one of the notches.

Preferably, the shaft is coated by isolation plastic and the function end is exposed from the isolation plastic.

Preferably, the insertion end of the shaft is a hexagonal end.

Preferably, the base has a threaded hole defined therethrough and a fastening member is threadedly engaged with the threaded hole. The positioning member has a positioning hole and the fastening member is connected to the positioning hole to connect the positioning member to the base.

Preferably, the space of the positioning member has a positioning stud located therein. An engaging recess is defined between positioning stud and the inside of the space. The resilient plate is inserted in the engaging recess of the positioning member and positioned by positioning stud.

Preferably, the reception recess of the ratchet member is a hexagonal recess.

Preferably, the switch has a positioning protrusion and a threaded hole is defined in the positioning protrusion. The fastening member in the central hole of the frame is threadedly connected to the threaded hole of the positioning protrusion to connect the switch to the frame.

The primary object of the present invention is to provide a ratchet screwdriver with a ratchet switch device wherein the switch is located at the rear end of the handle and quickly and conveniently change the operating direction of the ratchet screwdriver.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
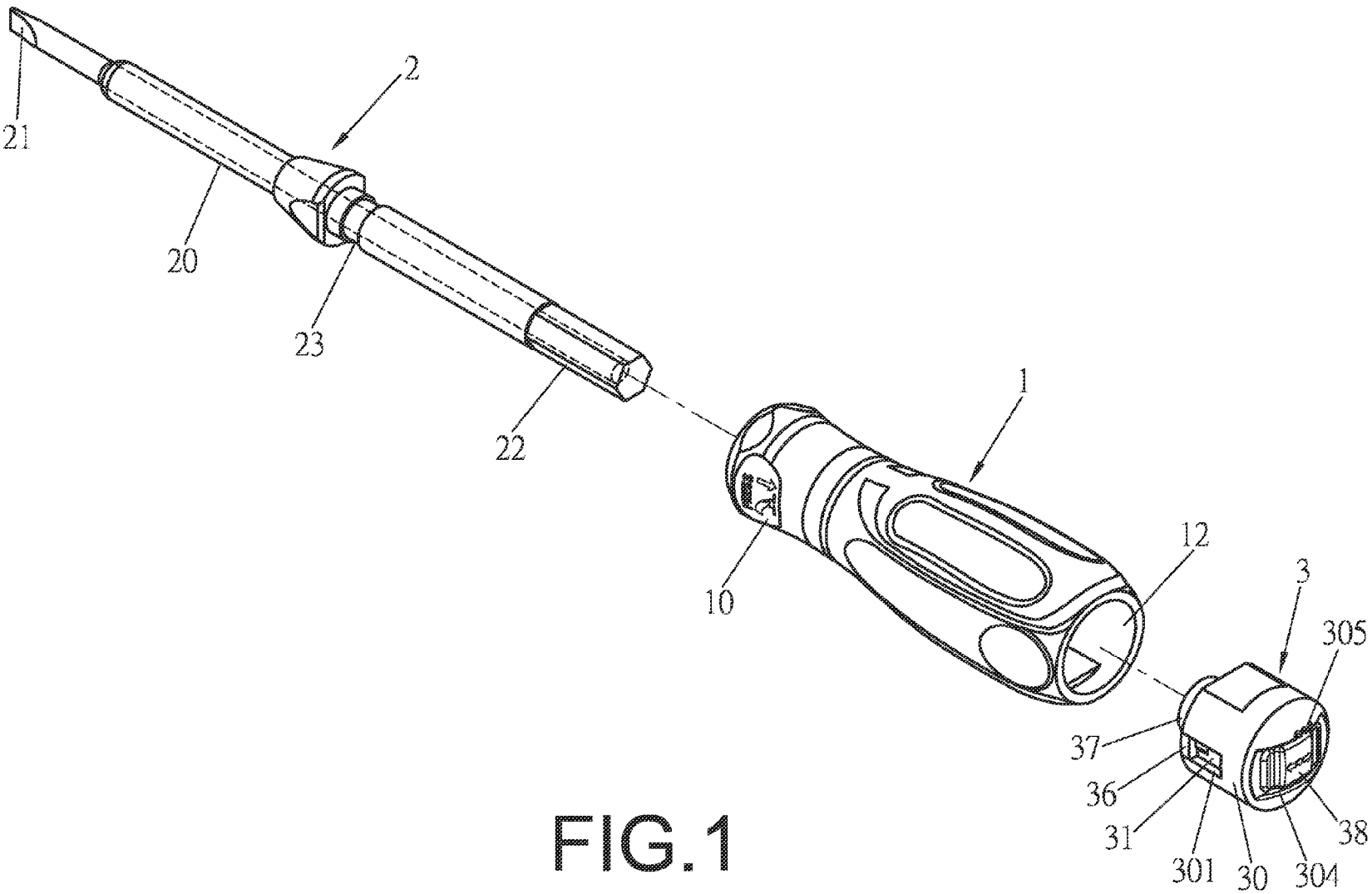
FIG. 1 is an exploded view to show the ratchet screwdriver of the present invention.
Figure 2:
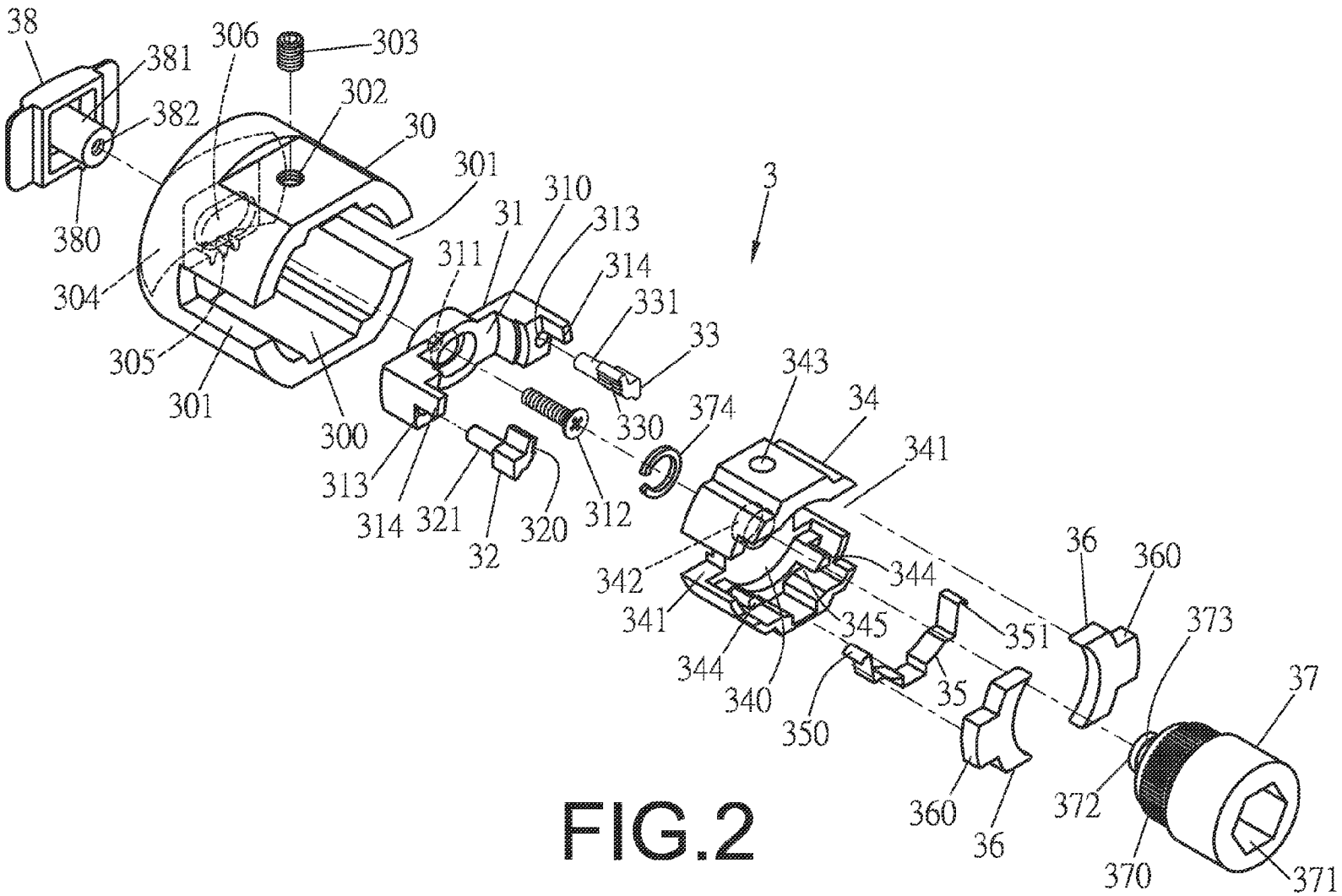
FIG. 2 is an exploded view to show the ratchet switch device of the ratchet screwdriver of the present invention.
Figure 3:
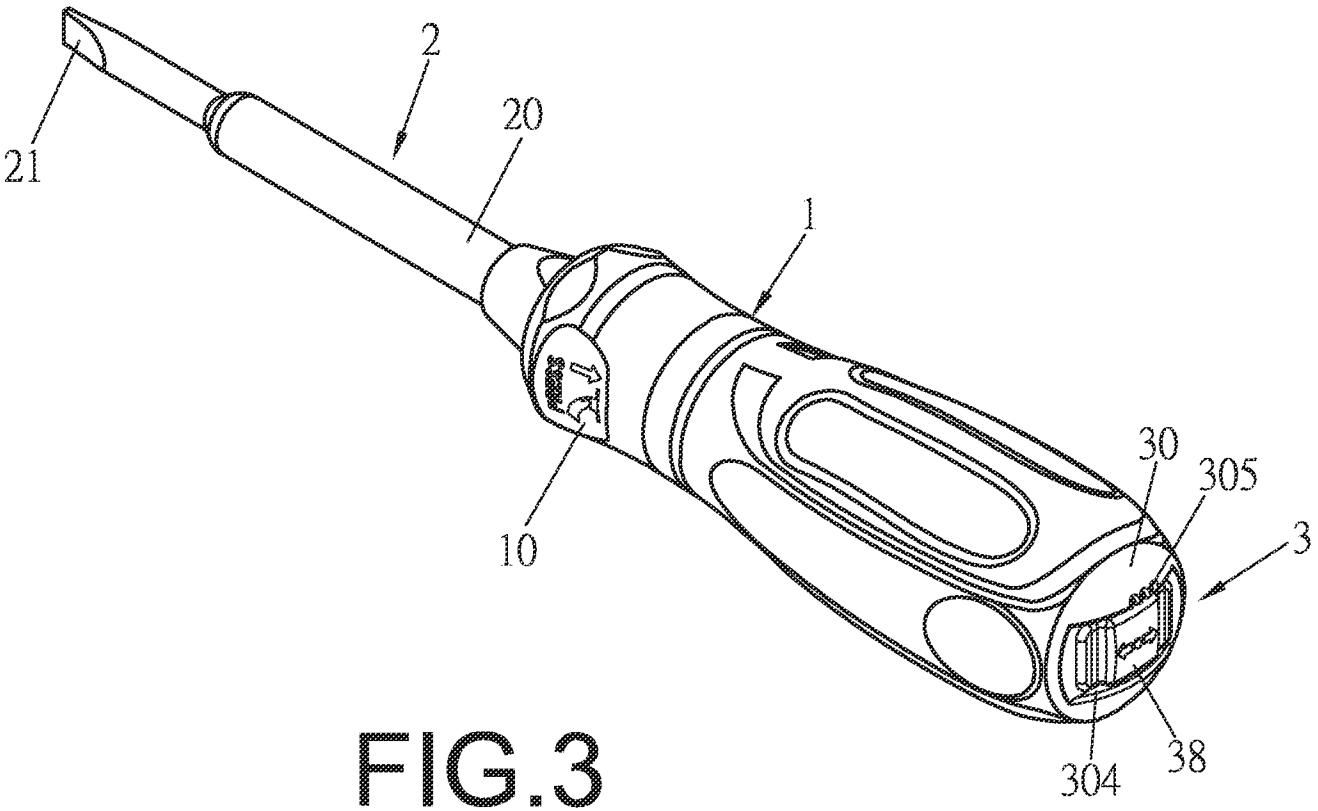
FIG. 3 is a perspective view to show the ratchet screwdriver of the present invention.
Figure 4:
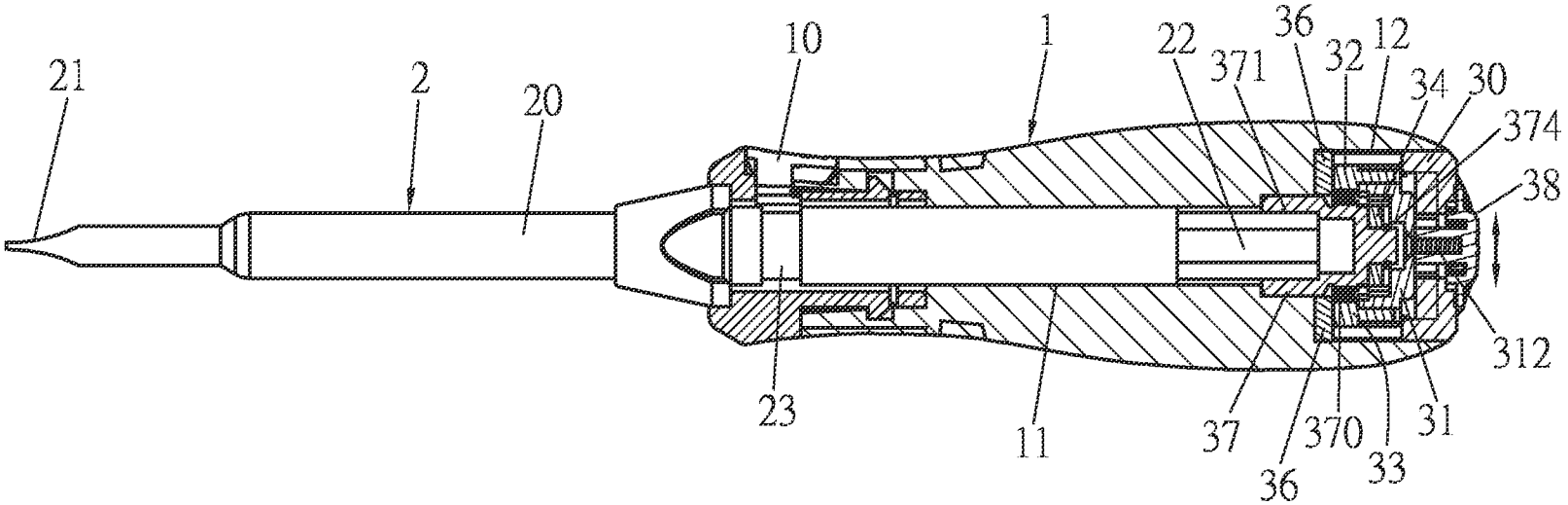
FIG. 4 is a cross sectional view of the ratchet screwdriver of the present invention.
Figure 5:
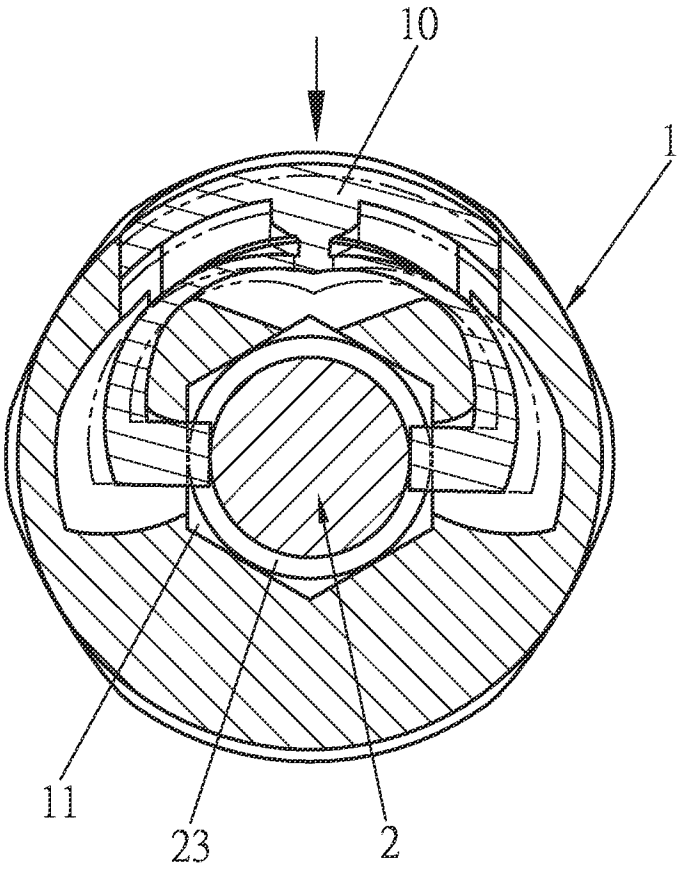
FIG. 5 shows the end cross sectional view of the connection of the shaft and the mounting member of the ratchet screwdriver of the present invention.
Figure 6:
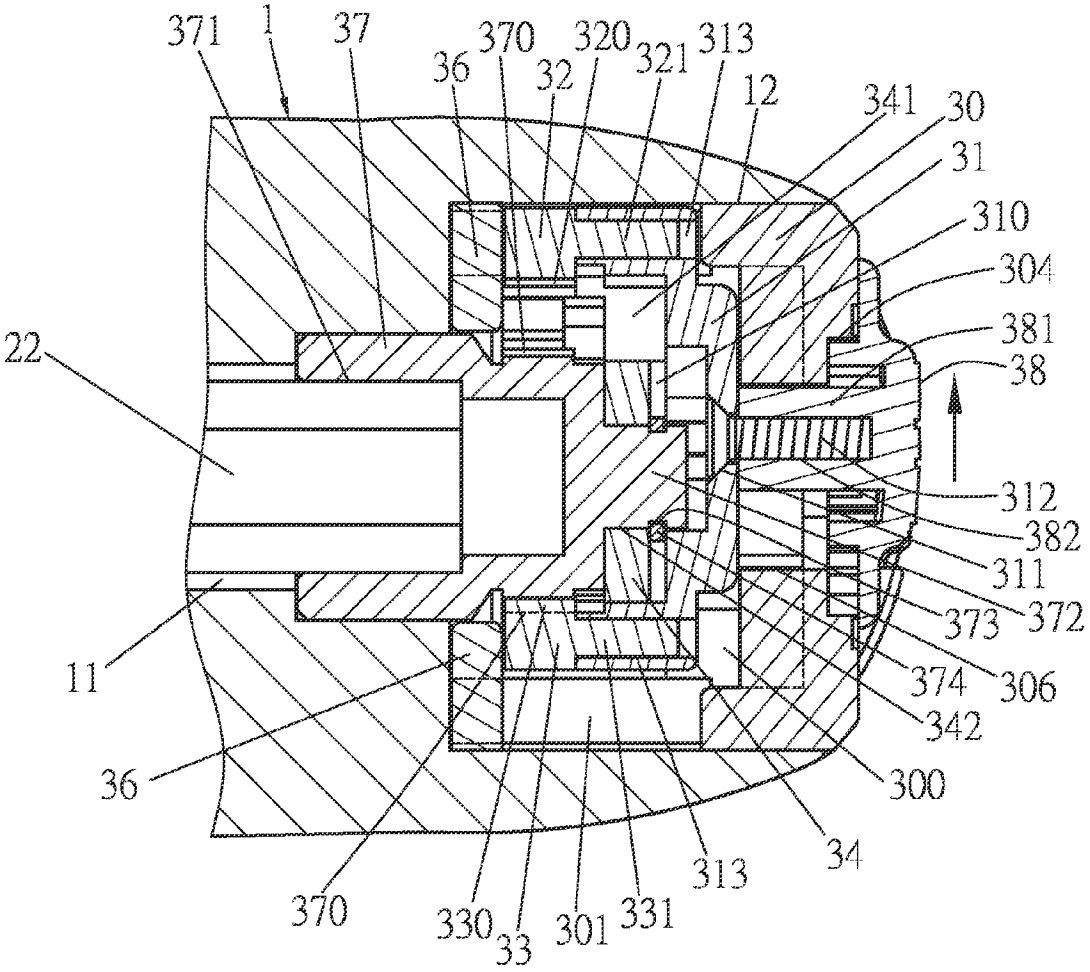
FIG. 6 is an enlarged cross sectional view of the ratchet switch device of the ratchet screwdriver of the present invention.

Referring to FIGS. 1 to 6, the ratchet screwdriver of the present invention comprises a handle 1, a shaft 2, and a ratchet switch device 3. The handle 1 has a mounting member 10 connected to the front end thereof and a chamber 12 is defined in the rear end of the handle 1. A passage 11 is defined in the handle 1 as shown in FIGS. 4 and 5.

The shaft 2 is inserted to the front end of the handle 1 and made by metal. The shaft 2 is coated by isolation plastic 20 and the function end 21 is exposed from the isolation plastic 20. The shaft 2 has a function end 21 on the front end thereof and an insertion end 22 is formed on the rear end of the shaft 2. A positioning recess 23 is defined in the shaft 2 and connected with the mounting member 10. Preferably, the insertion end 22 of the shaft 2 is a hexagonal end. A positioning recess 23 is defined in the shaft 2 and connected with the mounting member 10 on the handle 1.

The ratchet switch device 3 is located in the chamber 12 of the handle 1 and has a base 30 which has a room 300 defined therein. Two first slots 301 are defined in two opposite side walls alls of the base 30. The base 30 has a threaded hole 302 defined therethrough and a fastening member 303 is threadedly engaged with the threaded hole 302. A recessed area 304 is defined in the rear end of the base 30 and has multiple notches 305 defined in one side thereof. A through hole 306 is defined through the inside of the recessed area 304 and communicates with the room 300. A frame 31 is located in the room 300 of the base 30 and has a recess 310 defined therein. A central hole 311 is defined through the frame 31 and a fastening member 312 extends through the central hole 311. Each of two ends of the frame 31 has a reception hole 313 and a stop 314. Two engaging members 32, 33 are connected to the two ends of the frame 31 and each has ratchet teeth 320/330. Each of the two engaging members 32, 33 has an insertion 321/331 which is inserted into the reception hole 313 corresponding thereto. The two engaging members 32, 33 contact the stops 314 of the frame 31. A positioning member 34 is located in the recess 310 of the frame 31 and the room 300 of the base 30. The positioning member 34 has a space 340 defined therein and two second slots 341 are defined in two opposite walls thereof. A through hole 342 is defined through the positioning member 34. The positioning member 34 has a positioning hole 343 and the fastening member 303 is connected to the positioning hole 343 to connect the positioning member 34 to the base 30. The space 340 of the positioning member 34 has a positioning stud 344 located therein. An engaging recess 345 is defined between positioning stud 344 and the inside of the space 340. A resilient plate 35 is located in the space 340 of the positioning member 34 and the resilient plate 35 is inserted in the engaging recess 345 of the positioning member 34 and positioned by positioning stud 344. Each of two ends of the resilient plate 35 has a contact end 350/351. The two engaging members 32, 33 contact the contact ends 350, 351 respectively. Two positioning pieces 36 are located in the room 300 of the base 30 and a ratchet member 37 is located in the room 300 of the base 30. The ratchet member 37 has ratchet teeth 370 defined in outside thereof so as to be engaged with the ratchet teeth 320, 330 of the two engaging members 32, 33. The first end of the ratchet member 37 has a hexagonal reception recess 371 into which the insertion end 22 of the shaft 2 is inserted. A tubular part 372 extends from the second end of the ratchet member 37 and extends through the through hole 342 of the positioning member 34. The tubular part 372 has an annular groove 373 with which a clip 374 is engaged so as to connect the ratchet member 37 with the positioning member 34. A switch 38 is located in the recessed area 304 of the base 30 and connected with the frame 31. The switch 38 has a boss 380 extending therefrom which is engaged with one of the notches 305. The switch 38 further has a positioning protrusion 381 which has a threaded hole 382.

When assembling, the frame 31 is installed in the room 300 of the base 30 and the switch 38 is engaged with the recessed area 304 of the base 30. The positioning protrusion 381 of the switch 38 extends into the through hole 306 of the base 30 and the fastening member 312 extends through the central hole 311 of the frame 31 and is threadedly connected to the threaded hole 382 in the switch 38. The insertions 321, 331 of the two engaging members 32, 33 are inserted into the reception holes 313 of the frame 31 to connect the engaging members 32, 33 to the frame 31. The resilient plate 35 is installed to the engaging recess 345 of the positioning member 34 and positioned by the positioning studs 344 of the positioning member 34. The two positioning pieces 36 are respectively installed in the space 340 of the positioning member 34 and the protrusions 360 of the two positioning pieces 36 are engaged with the second slots 341. The tubular part 372 of the ratchet member 37 is inserted into the through hole 342 of the positioning member 34 and the clip 374 is engaged with the groove 373 to connect the ratchet member 37 with the positioning member 34. The positioning member 34, the positioning pieces 36 and the ratchet member 37 are installed in the room 300 of the base 30. The engaging members 32, 33 are engaged with the two second slots 341 of the positioning member 34. The ratchet teeth 320, 330 of the engaging members 32, 33 are located corresponding to the ratchet teeth 370 of the ratchet member 37. The fastening member 303 is connected to the threaded hole 302 of the base 30 and protrudes into the positioning hole 343 of the positioning member 34 to fix the positioning member 34 to the base 30. The ratchet switch device 3 is installed in the chamber 12 of the handle 1. The shaft 2 is inserted into the passage 11 of the handle 1. The insertion end 22 of the shaft 2 is inserted into the reception recess 371 of the ratchet member 37. The shaft 2 is positioned by the mounting member 10.

Figure 7:
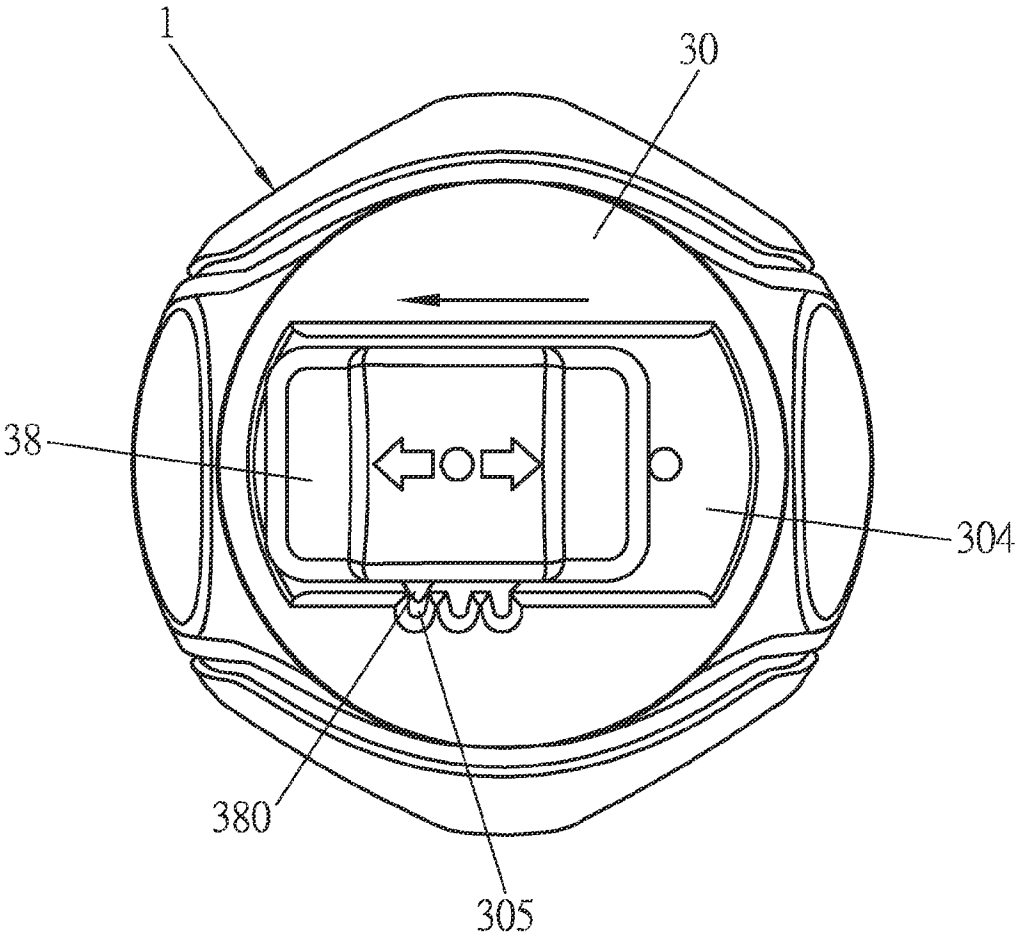
FIG. 7 shows that the switch of the ratchet switch device of the ratchet screwdriver of the present invention is shifted to one position.
Figure 8:
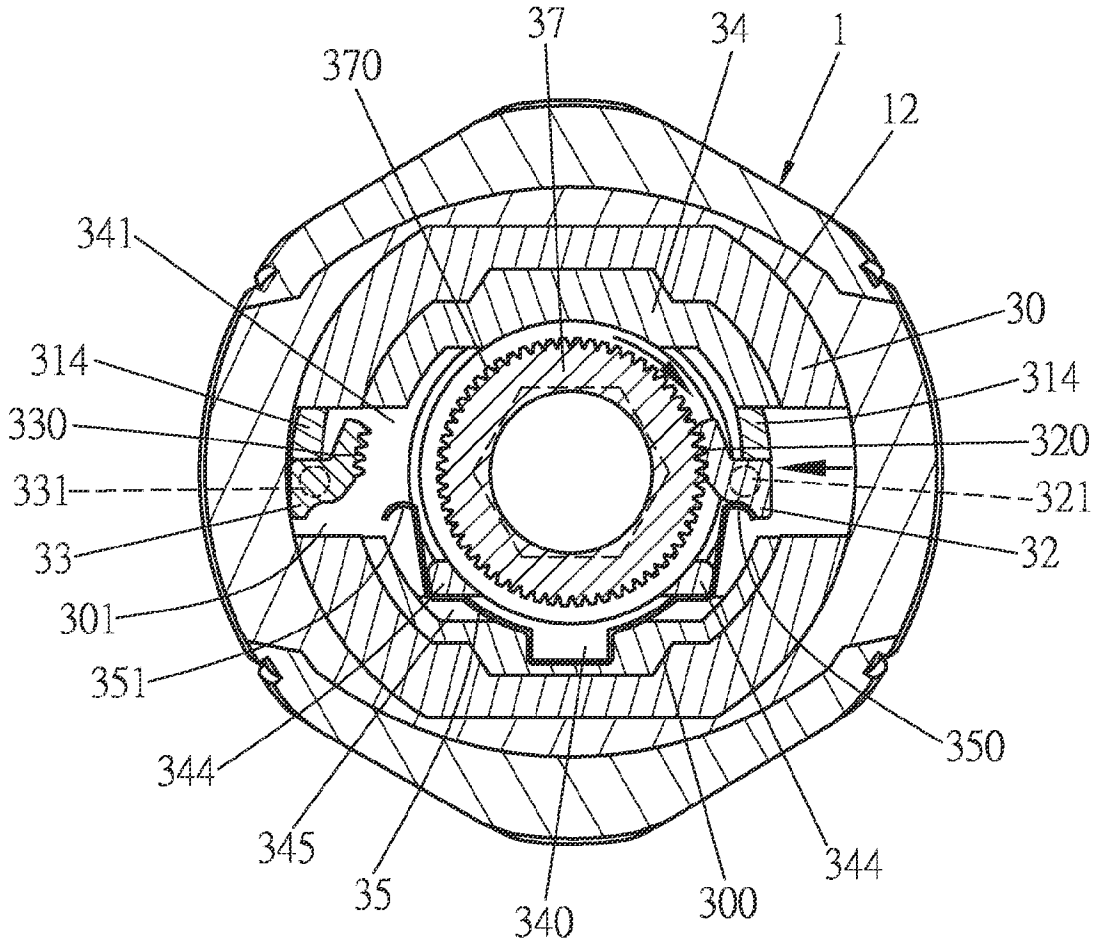
FIG. 8 is an end cross sectional view to show the ratchet switch device of the ratchet screwdriver of the present invention when the switch is shifted to one position.

Referring to FIGS. 3 to 11, the shaft 2 can be replaced by pressing the mounting member 10 as shown in FIG. 3 so as to have different shaft 2. The isolation plastic 20 provides electric isolation to the shaft 2. When in use, the switch 38 is shifted to one side to engage the boss 380 with one of the notches 305 as shown in FIG. 7. When the switch 38 is shifted, the frame 31 is driven and the frame 31 drives the two engaging members 32, 33. The ratchet teeth 320 of the engaging member 32 are engaged with the ratchet teeth 370 of the ratchet member 37 as shown in FIG. 8. The bottom of the engaging member 32 is biased by the contact end 350 of the resilient plate 35 so that the top end of the engaging member 32 is stopped by the stop 314 of the frame 31. When the user rotates the handle 1 clockwise, the shaft 2 and the ratchet member 37 are co-rotated. The engaging member 32 cannot be moved downward by the stop 314 so that the ratchet teeth 320 of the engaging member 32 are firmly engaged with the ratchet teeth 370 of the ratchet member 37. The ratchet member 37 cannot rotate due to the engaging member 32 as shown in FIG. 8, the shaft 2 outputs torque to the object clockwise.

Figure 9:
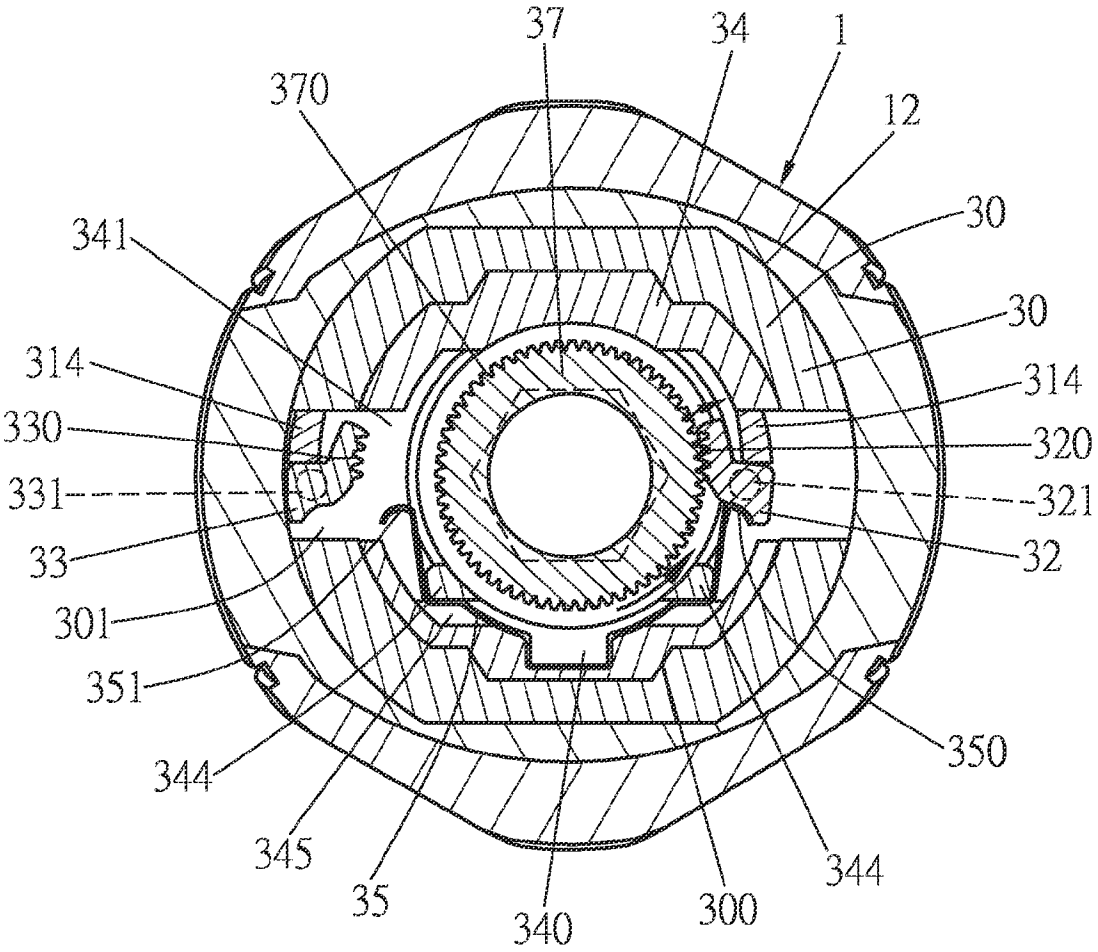
FIG. 9 shows that the ratchet member is rotated in opposite direction and the engaging member is pushed outward.
Figure 10:
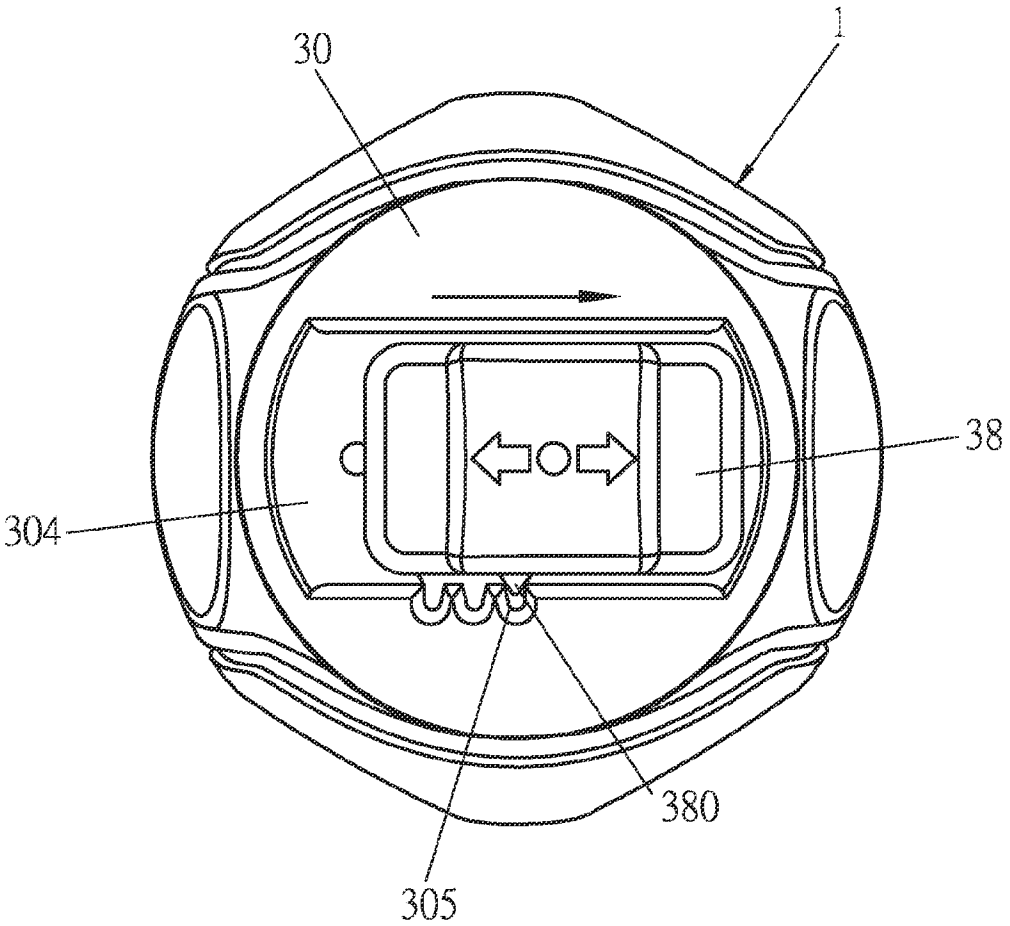
FIG. 10 shows that the switch of the ratchet switch device of the ratchet screwdriver of the present invention is shifted to the other one position.
Figure 11:
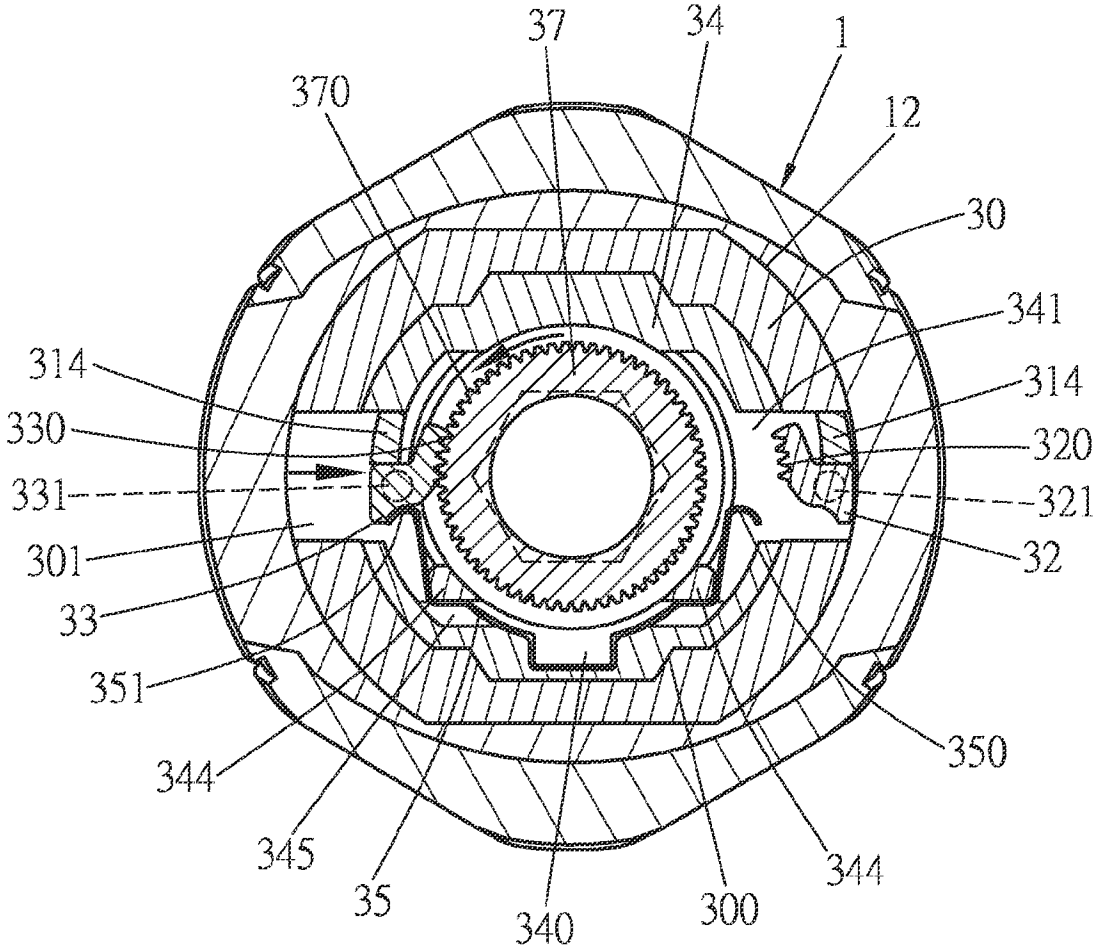
FIG. 11 is an end cross sectional view to show the ratchet switch device of the ratchet screwdriver of the present invention when the switch is shifted to the other one position.

When the user rotates the handle 1 counter clockwise, the ratchet member 37 is rotated counter clockwise and pushes the engaging member 32. The engaging member 32 is pivoted about the insertion 321 outward as shown in FIG. 9. The contact end 350 of the resilient plate 35 at the bottom of the engaging member 32 is compressed so that the engaging member 32 moves over the ratchet teeth 370 of the ratchet member 37. Therefore, the user can rotate the handle 1 backward and forward to quickly tighten the object. When the user wants to loosen the object, the switch 38 is shifted to the other direction and the boss 380 is engaged with the other one of the notches 305 as shown in FIG. 10. The frame 31 is driven by the switch 38 toward the other direction and the two engaging members 32, 33 are driven by the frame 31. The ratchet teeth 320 of the engaging member 32 are disengaged from the ratchet teeth 370 of the ratchet member 37, while the ratchet teeth 330 of the other engaging member 33 are engaged with the ratchet teeth 370 of the ratchet member 37 as shown in FIG. 11. The bottom of the engaging member 33 is biased by the other contact end 351 of the resilient plate 35 so that the top end of the engaging member 33 is stopped by the other stop 314 of the frame 31. When the user rotates the handle 1 counter clockwise, the shaft 2 and the ratchet member 37 are co-rotated. The engaging member 33 cannot move downward by the stop 314 so that the ratchet teeth 330 of the engaging member 33 are firmly engaged with the ratchet teeth 370 of the ratchet member 37. The ratchet member 37 cannot rotate due to the engaging member 33. The shaft 2 outputs torque to loosen the object.

When the user rotates the handle 1 clockwise, the ratchet member 37 is rotated clockwise and pushes the engaging member 33. The engaging member 33 is pivoted about the insertion 331 outward. The contact end 351 of the resilient plate 35 at the bottom of the engaging member 33 is compressed so that the engaging member 33 moves over the ratchet teeth 370 of the ratchet member 37. Therefore, the ratchet screwdriver does not output torque to the object when rotating clockwise, the user can rotate the handle 1 backward and forward to quickly loosen the object.

While we have shown and described the embodiment in accordance with the present invention, it should be clear to those skilled in the art that further embodiments may be made without departing from the scope of the present invention.

What is claimed is:

1. A ratchet screwdriver comprising:

a handle having a mounting member connected to a front end thereof and a chamber defined in a rear end of the handle, a passage defined in the handle;

a shaft inserted to the front end of the handle and being made by metal, the shaft having a function end on a front end thereof and an insertion end formed on a rear end of the shaft, a positioning recess defined in the shaft and connected with the mounting member;

a ratchet switch device located in the chamber of the handle and having a base, the base having a room defined therein, two first slots defined in two opposite sidewalls of the base, a recessed area defined in a rear end of the base and having multiple notches defined in one side thereof, a through hole defined through an inside of the recessed area and communicating with the room; a frame located in the room of the base, the frame having a recess defined therein and a central hole defined through the frame, a fastening member extending through the central hole, each of two ends of the frame having a reception hole and a stop; two engaging members connected to the two ends of the frame and each having ratchet teeth, each of the two engaging members having an insertion which is inserted into the reception hole corresponding thereto, the two engaging members contacting the stops of the frame; a positioning member located in the recess of the frame and the room of the base, the positioning member having a space defined therein and two second slots defined in two opposite walls thereof, a through hole defined through the positioning member; a resilient plate located in the space of the positioning member and each of two ends of the resilient plate having a contact end, the two engaging members contacting the contact ends respectively; two positioning pieces located in the room of the base and a ratchet member located in the room of the base, the ratchet member having ratchet teeth defined in outside thereof so as to be engaged with the ratchet teeth of the two engaging members, a first end of the ratchet member having a reception recess into which the insertion end of the shaft is inserted, a tubular part extending from a second end of the ratchet member and extending through the through hole of the positioning member, the tubular part having an annular groove with which a clip is engaged so as to connect the ratchet member with the positioning member, and a switch located in the recessed area of the base and connected with the frame, the switch having a boss extending therefrom which is engaged with one of the notches.

2. The ratchet screwdriver as claimed in claim 1, wherein the shaft is coated by isolation plastic and the function end is exposed from the isolation plastic.

3. The ratchet screwdriver as claimed in claim 1, wherein the insertion end of the shaft is a hexagonal end.

4. The ratchet screwdriver as claimed in claim 1, wherein the base has a threaded hole defined therethrough and a fastening member is threadedly engaged with the threaded hole, the positioning member has a positioning hole and the fastening member is connected to the positioning hole to connect the positioning member to the base.

5. The ratchet screwdriver as claimed in claim 1, wherein the space of the positioning member has a positioning stud located therein, an engaging recess is defined between positioning stud and an inside of the space, the resilient plate is inserted in the engaging recess of the positioning member and positioned by positioning stud.

6. The ratchet screwdriver as claimed in claim 1, wherein the reception recess of the ratchet member is a hexagonal recess.

7. The ratchet screwdriver as claimed in claim 1, wherein the switch has a positioning protrusion and a threaded hole is defined in the positioning protrusion, the fastening member in the central hole of the frame is threadedly connected to the threaded hole of the positioning protrusion to connect the switch to the frame.

* * * * *